United States Patent [19]

Nussbaumer et al.

[11] Patent Number: 4,697,953

[45] Date of Patent: Oct. 6, 1987

[54] METHOD AND APPARATUS FOR SUBSEQUENT UNDERGROUND SEALING

[75] Inventors: Manfred Nussbaumer, Leonberg; Eberhard Gläser, Aichwald; Eberhard Beitinger, Stuttgart; Hartmann Eckardt, Leutenbach-Weiler, all of Fed. Rep. of Germany

[73] Assignee: Ed. Züblin Aktiengesellschaft, Stuttgart, Fed. Rep. of Germany

[21] Appl. No.: 706,661

[22] Filed: Feb. 28, 1985

[30] Foreign Application Priority Data

Feb. 29, 1984 [DE] Fed. Rep. of Germany ..... 3407382

[51] Int. Cl.[4] ..... B09B 1/00; E02D 5/18

[52] U.S. Cl. ..... 405/128; 405/57; 405/267; 405/270

[58] Field of Search ..... 405/38, 53, 54, 55, 405/57, 132, 263, 265, 266–271, 128, 129

[56] References Cited

U.S. PATENT DOCUMENTS

| | | | |
|---|---|---|---|
| 2,196,211 | 4/1940 | Hartman | 405/269 |
| 3,608,318 | 9/1971 | Levy et al. | 405/266 |
| 3,645,101 | 2/1972 | Sherard | 405/267 |
| 4,057,969 | 11/1977 | Rochmann | 405/267 |
| 4,112,690 | 9/1978 | Hosoya et al. | 405/57 |
| 4,304,507 | 12/1981 | Sato | 405/267 |
| 4,352,601 | 10/1982 | Valiga et al. | 405/270 |
| 4,375,930 | 3/1983 | Valiga | 405/267 X |
| 4,379,658 | 4/1983 | Schmednecht | 405/267 |
| 4,426,175 | 1/1984 | Lin | 405/269 X |
| 4,436,453 | 3/1984 | Miura et al. | 405/269 X |

FOREIGN PATENT DOCUMENTS

| | | | |
|---|---|---|---|
| 95711 | 7/1980 | Japan | 405/267 |
| 81523 | 5/1982 | Japan | 405/267 |

*Primary Examiner*—Cornelius J. Husar
*Assistant Examiner*—Nancy J. Stodola
*Attorney, Agent, or Firm*—Becker & Becker, Inc.

[57] ABSTRACT

A method and apparatus for the subsequent underground sealing of an area, preferably of dumps. With the method, it is possible to seal dumps underground. Working pipes are introduced from a region outside a dump body. The region of soil between the working pipes is loosened, and sealing material is then introduced into this region, which solidifies to become a sheet-like sealing compound. With this method, in particular existing dump bodies can be sealed subsequently underground, without having to drill through the dump body. The apparatus for carrying out the method has a loosening device, and a feed device for the sealing material. The two devices are able to move in the region between two adjacent working pipes.

33 Claims, 24 Drawing Figures

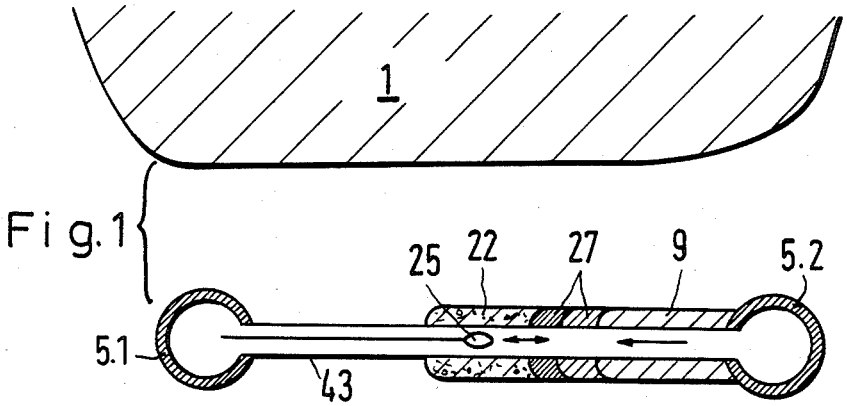
Fig. 1
Fig. 2
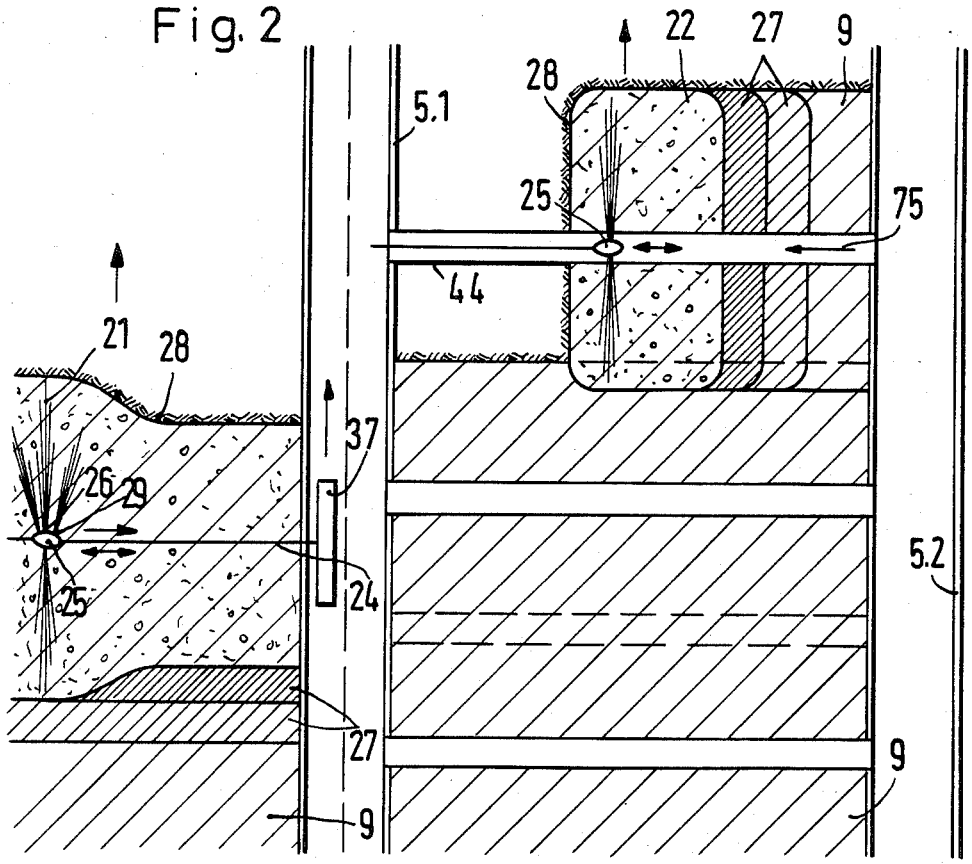

Fig. 7
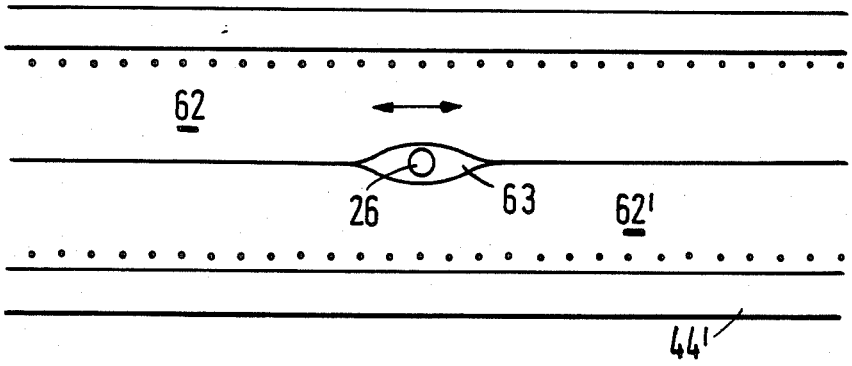
Fig. 8.1
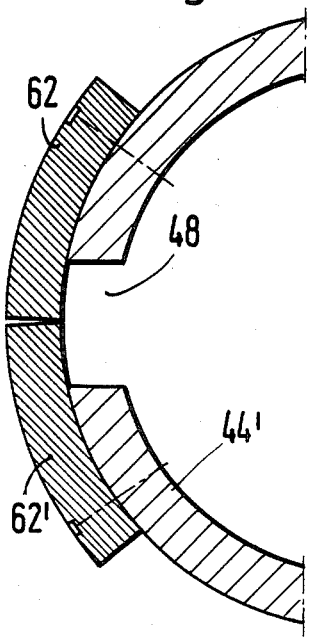
Fig. 8.2
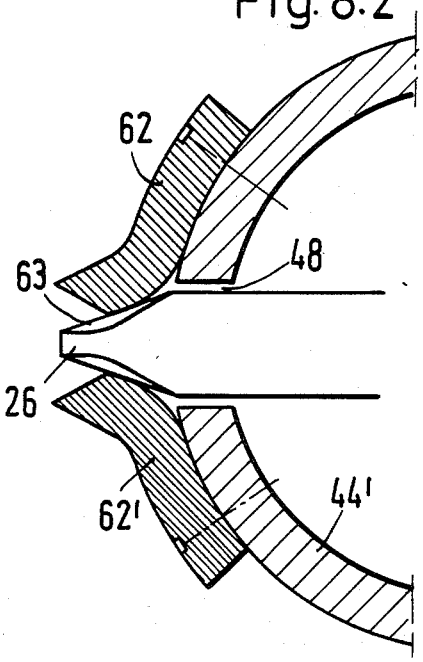

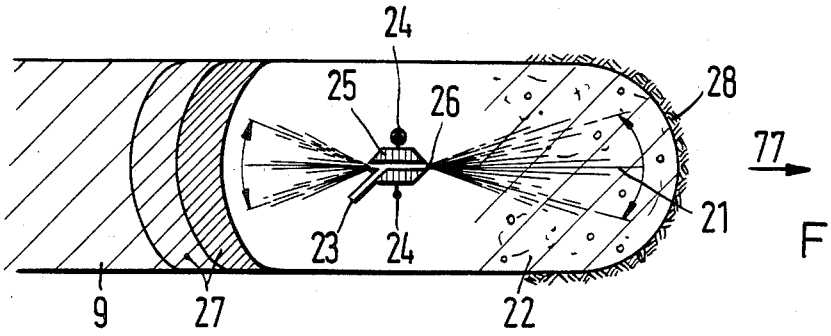
Fig. 9
Fig. 10
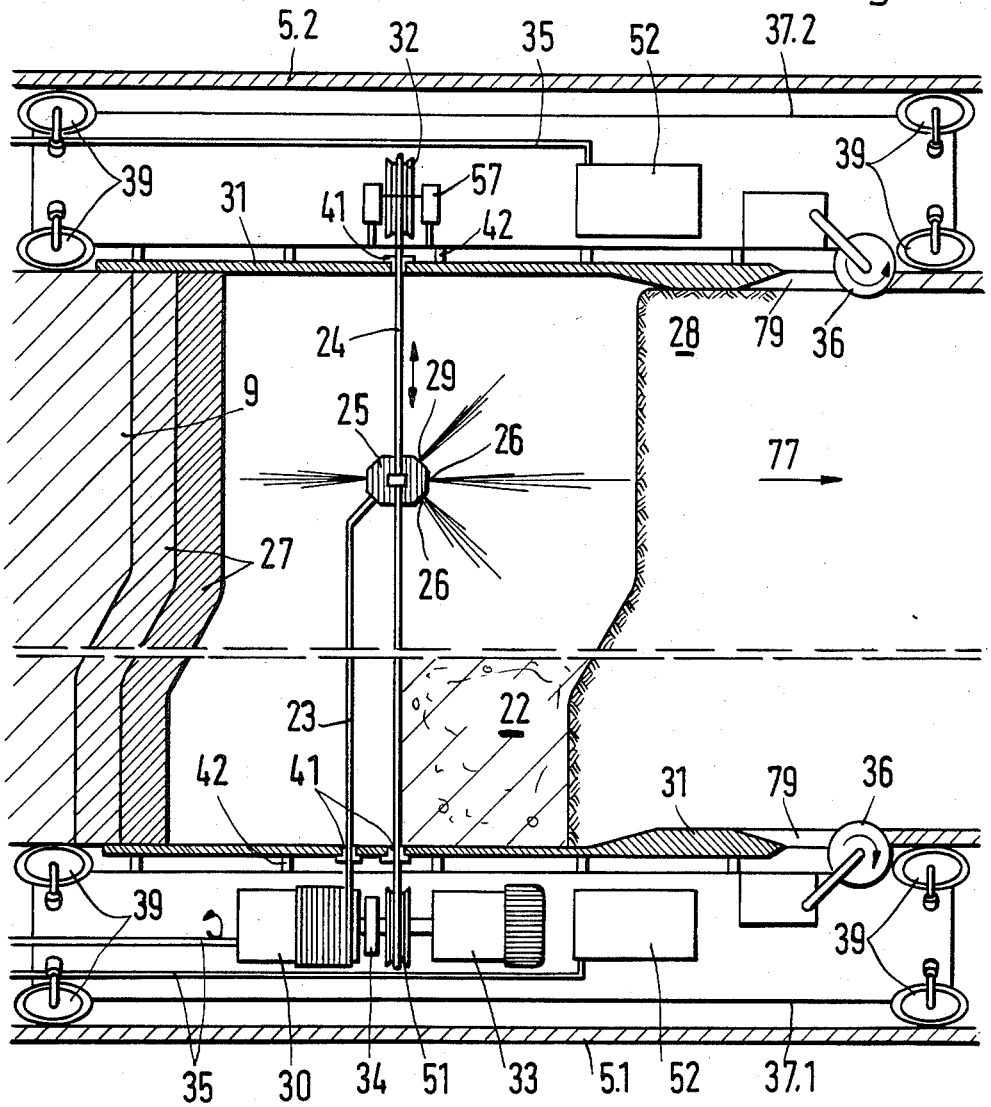

METHOD AND APPARATUS FOR SUBSEQUENT UNDERGROUND SEALING

BACKGROUND OF THE INVENTION

1. Field of the Invention

The present invention relates to a method and apparatus for the subsequent underground sealing of an area, preferably of a dump, according to which a sheet-like sealing compound is introduced in the region outside the dump.

2. Description of the Prior Art

Dumps are places for depositing waste products of all types. As regards endangering human beings and the environment, these waste materials may contain harmful substances which may be brought into circulation by seepage water, leakages, erosion, or the method of introduction, and may pass through the earth into the water table. Many dumps were not adequately and promptly protected against an influence of the water table and a contamination of the soil, so that it was subsequently necessary to clean them up. The cleaning-up measures can be divided into three main groups:

(a) the transfer of the old deposits to an orderly, i.e. sealed, dump, (b) encapsulation by covering and vertical and horizontal subsequent sealing, and (c) hydraulic cleaning-up measures.

The transfer of the old deposits generally involves high costs, and the question arises as to whether excavation of the actual old deposits is sufficient, or whether or not the contaminated subsoil must also be excavated.

Known hydraulic cleaning-up measures are the diversion of the water table or ground water by vertical guide walls, the lowering of the water table level, the removal of the ground water in order to alter the flow, and the provision of protective wells. However, these measures require high operating costs, and with permeable earth generally do not guarantee any reliable protection from moving harmful substances, which move toward the water table.

Known and proven methods exist for encapsulation by covering and vertical sealing. However, no developed measures are available for the horizontal underground sealing. Horizontal sealing by injected sealing surfaces, which are introduced by way of vertical bores at intervals of one to three meters, has the essential drawback that it is necessary to bore through the dump body; thus, stationary harmful substances are brought into circulation, and can be fed through the bore hole directly to the water table.

An object of the present invention is to provide a method and apparatus for the complete in particular horizontal, sealing of dumps, according to which the dump body remains completely undisturbed, and subsequent encapsulation of old deposits which are harmful to the environment is possible.

BRIEF DESCRIPTION OF THE DRAWINGS

This object, and other objects and advantages of the present invention, will appear more clearly from the following specification in conjunction with several inventive embodiments illustrated in the drawings, in which:

FIG. 1 is a view that shows an apparatus for carrying out the method according to the invention, in diagrammatic illustration;

FIG. 2 is a view that shows two embodiments of the method according to the invention, in diagrammatic illustration;

FIG. 7 is a side view of a pipe, in which an apparatus for carrying out the method is able to travel;

FIG. 8.1 is a view that shows part of the pipe according to FIG. 7 in section, which is provided with a slot, which is covered by two elastically yielding sealing members;

FIG. 8.2 is a view that shows a nozzle of the apparatus according to the invention projecting through the slot of the pipe according to FIG. 8.1;

FIG. 9 is a view that diagrammatically shows a nozzle member of the apparatus according to the invention, by which the ground is loosened hydraulically and is mixed with additives;

FIG. 10 is a plan view of the apparatus according to FIG. 9;

SUMMARY OF THE INVENTION

Figure 3:
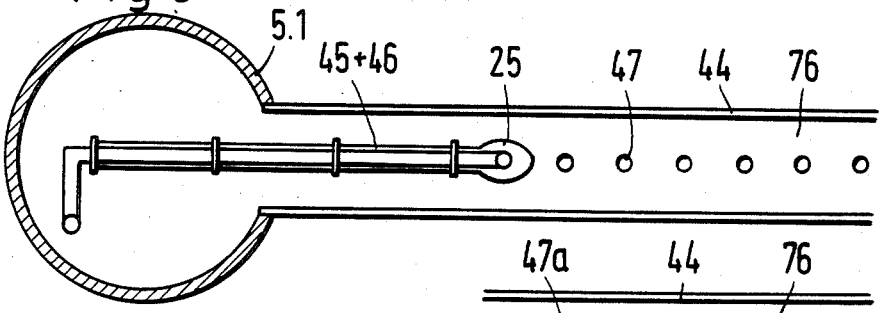
FIG. 3 is a view that shows part of an apparatus according to the invention for carrying out the method, in section.

The method of the present invention is characterized primarily in that working pipes are installed from a region outside the dump body, and in that the area of earth between adjacent working pipes is loosened and then sealing material is introduced into this area, which material hardens to become the sealing compound.

Furthermore, the apparatus of the present invention is characterized primarily in that it comprises at least one loosening device, and at least one feed device for the sealing material; these devices are able to be moved in the region between two adjacent working pipes.

With the method according to the invention, it is possible for the first time to subsequently introduce a closed sealing surface below the existing dump body, without the dump body being damaged. The working pipes are laid from the side, and from these pipes the earth material is loosened and the additives are introduced. A complete encapsulation of the dump can thus be achieved with the method according to the invention. With the method according to the invention it is also possible, in particular, to produce horizontal sealing surfaces below the dump body. In this case, the working pipes are introduced from the region outside the dump body laterally and below the dump body. The horizontal sealing surface an impermeable manner. With a suitable selection of additives, such as binders, water, and/or chemicals, a durable and maintenance-free sealing surface can be produced economically with the method according to the invention. In principle, the method is suitable for any subsoil of old deposits, and even with changing water table conditions and permeability of the layers of earth, represents effective protection from contamination of the environment outside the closed sealing surface by harmful substances from the old deposits.

With the apparatus according to the invention, the sealing surface can be produced in a structurally simple manner. The earth material in the region between the working pipes is loosened by the loosening device. In this case, the loosening device is moved between adjacent working pipes. The respective additive is then introduced by means of the device; this additive forms the sealing surface per se or in conjunction with the loosened earth material.

Description of Preferred Embodiments

Referring now to the drawings in detail, with the method and apparatus described hereafter, existing dumps are subsequently sealed underground, generally relative to the water table. This subsequent sealing represents a preferred application for sealing a dump. However, these methods and apparatus may also serve, for example, for sealing earth masses which are provided from excavations and which have to be sealed, especially relative to the ground water.

Figure 20:
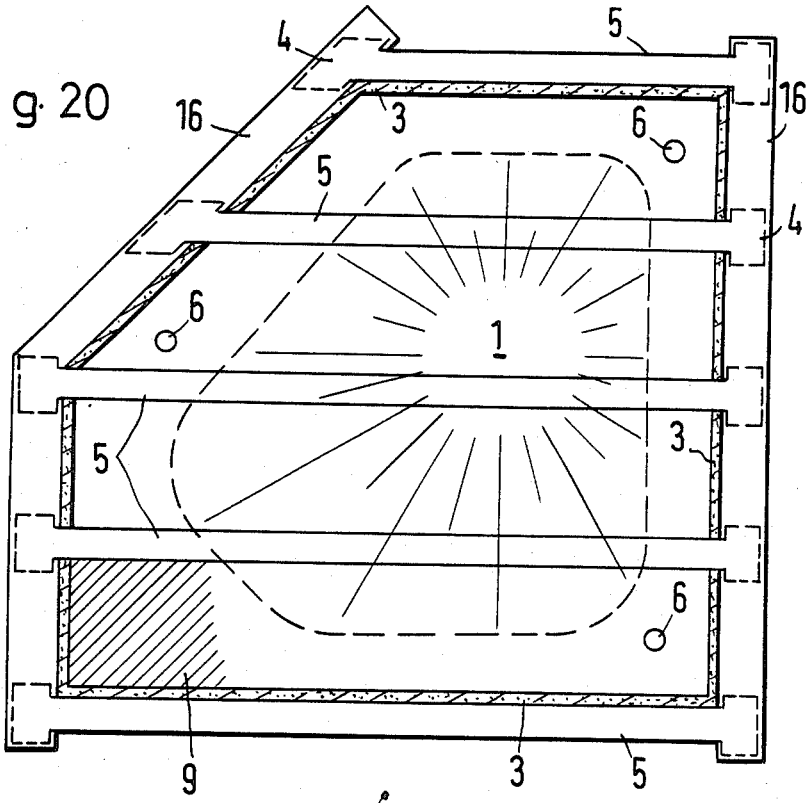
FIG. 20 is a view showing a diagrammatic illustration and plan view of a dump body, which is sealed underground by a horizontal sealing surface.

As shown in FIGS. 1 and 20, working pipes 5 are introduced by the known driving method below an existing dump body 1. For this purpose, vertical shafts 4 are advantageously sunk outside the dump surface; from these shafts, installation of the working pipes 5 by the driving method takes place in a suitable manner as far as a boundary shaft. The working pipes 5 are laid at intervals of 50 to 100 meters, for example, so that they cover the entire surface which is to be sealed below the dump body (FIG. 20). Adjacent working pipes 5 are respectively connected to each other by mechanical connections 43, which may be rigid or may be arranged to travel along the working pipes. Devices for loosening the surrounding layer of earth, for introducing additives such as binders, water, and/or chemicals, and for mixing the loosened soil constituents with the additives in situ, i.e. immediately at the location, may be provided along the mechanical connections or the latter. The diameter of the working pipes 5 is such that these mechanical connections 43 can be produced without difficulties. With the devices, a horizontal sealing compound 9 is produced from the loosened soil constituents and the additives, which sealing compound 9 seals the dump body 1 on its underside over its entire bottom surface (FIG. 20).

In the embodiment according to FIGS. 1 to 6, adjacent working pipes 5.1 and 5.2 are connected to each other by pipes 44 disposed at right angles thereto, as mechanical connecting means 43. In the pipes 44, a nozzle member 25 is moved in the longitudinal direction of the pipe. A mixture of binders, for example cement, water, and/or chemicals, is emitted at high pressure by nozzles 26 through the wall of the pipe 44 onto the layer of earth 28 in the vicinity of the pipe. This jet 21 loosens the constituents of the soil and at the same time mixes them to form the homogeneous sealing compound 9, which is durable after hardening. The movement of the nozzle member 25 is controlled in such a way that a closed sealing surface is produced along the pipe 44 between the working pipes 5.1 and 5.2 over a defined width.

In the illustration according to FIG. 2, the nozzle member 25 is moved in the direction of the arrow 75 from the working pipe 5.2 to the working pipe 5.1. With the nozzle member 25, the ground 28 is loosened and mixed in an approximately rectangular shape. Since mixing takes place in situ, the mixed material already begins to harden while the nozzle member 25 is still moving through the pipe 44. In the position of the nozzle member 25 in FIG. 2, the regions close to the working pipe 5.2 have already hardened, whereas the adjoining regions in the direction towards the working pipe 5.1, as far as the actual working region of the nozzle member, are increasingly softer. As shown in the right-hand half of FIG. 2, overlapping regions having different degrees of solidification are formed in this way. At the end of the working process, a continuous, homogeneous sealing compound 9 is thus formed, as illustrated for the lower region in FIG. 2. The pipes 44 are arranged at such intervals that the working region of the nozzle member 25 also loosens the edge of the sealing compound 9 formed when it traveled along the previous pipe, so that a hermetic connection of the respective sections of the sealing surface is guaranteed. The region between adjacent pipes 44 is thus completely filled with the sealing compound 9 in the horizontal direction. The area of overlap of the sealing surface sections formed when traveling along adjacent pipes 44 is shown in broken lines in FIG. 2.

In the method illustrated in the right-hand half of FIG. 2, the sealing surface 9 is produced in sections, in which case the nozzle member 25 travels through each of the pipes 44. In the left-hand half of FIG. 2, the nozzle member 25 is attached to a cable 24, which extends between two carriages, with only one carriage 37 being illustrated in FIG. 2. The carriages 37 are able to travel in adjacent working pipes at the same speed. The nozzle member 25 is thus moved back and forrh by the cable 24, in which case the earth 28 is loosened and mixed with the additives in the manner described. In this way, the sealing surface 9 is produced continuously. This is described hereafter in detail with reference to FIG. 10.

The working pipes 5 are inserted below the dump body 1 by the driving method. Naturally, the working pipes can also be laid in any other manner, for example in that an inserted hollow section is coated with molded or gunned concrete and the like. In the embodiment illustrated and described, the working pipes 5 have a circular cross section. However, they may also have any other suitable cross section. The pipes 44 are appropriately introduced from the respective working pipe by the driving method. The earth 28 is loosened under high pressure by means of the nozzle member 25 by spraying out the respective binder, and the loosened earth is thus simultaneously mixed with the binder. Cement, lime, or cement/lime mixtures and the like may be used as binders, for example, which are sprayed out together with water. If the binder itself is already liquid, it is possible to dispense with the addition of water. Instead of binders, with or without the addition of water, chemicals may also be used with which a seal can be achieved. Water glass (sodium silicate), for example, may be used as a chemical, which if necessary can be mixed with a hardener.

In the embodiments, all of the loosened soil constituents are mixed with the binder and/or chemical. Depending on the requirements, the nature of the soil, and the like, only part of the loosened soil constituents may be mixed; the other part of the soil constituents is then removed. Also, the entire loosened soil constituents may be removed and replaced by the binder and/or the chemical.

The nozzle member 25 according to FIGS. 1 to 6 has two opposing main nozzles 26, which are preferably arranged to move on the nozzle member, and from which the material is sprayed horizontally into the earth 28 in opposite directions. Due to this, as it travels through the pipe 44, both areas beside the pipe opposite each other can be covered simultaneously. However, the nozzle member 25 may also have only a single main nozzle. In this case it must travel through the respective pipe 44 twice in order to cover the regions beside the pipe 44. In addition to the main nozzle or nozzles, the nozzle member 25 may comprise on one or on both sides at least one auxiliary nozzle 29 which is preferably likewise able to move, so that the material can be sprayed over a wider area.

As shown in FIG. 3, the respective working pipe 5.1 is in open connection with the pipe 44, which has a smaller diameter than does the working pipe. The wall 76 of the pipe 44 is provided with round openings 47, which lie one after the other at a distance apart in the axial direction. The nozzle member 25 is moved in the pipe 44 in such a way that its nozzles 26, 29 spray the binder and/or chemicals under pressure into the earth 28 through the openings 47. The nozzle member 25 is attached to a holding device 45, which is connected to a feed line 46 for the nozzle member. The hydraulic loosening and mixing of the soil thus takes place by way of the jet 21, which is sprayed through the round openings 47 in the wall 76. The feed line 46 is guided through the respective working pipe 5.1 to the shaft 4, and then upwards to the earth's surface.

Figure 4:
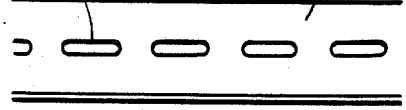
FIG. 4 is a view that shows a pipe for use in the method according to the invention.

The openings in the wall 76 of the pipe 44 may also be elongated slots 47*a* (FIG. 4). They extend in the axial direction of the pipe 44, and are likewise provided opposite each other in the pipe wall 76.

The pipe 44 may also consist of a material, for example synthetic material, which can be penetrated by the hydraulic jet 21, so that the jet itself cuts the necessary openings in the pipe wall 76. The material of the pipe wall, the pressure of the jet, the speed of the jet, and the density of the jet are co-ordinated with each other in such a way that the pipe wall 76 offers no appreciable resistance to the passage of the jet 21. The openings for the jet 21 may also be produced with a suitable tool only shortly before the passage of the jet.

Figure 5:
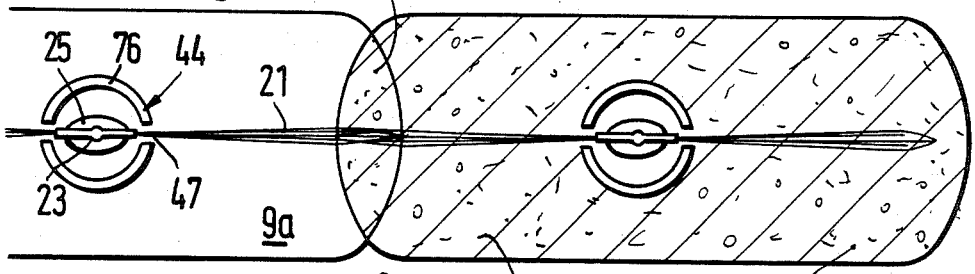
FIG. 5 is a view showing a section through two portions of a sealing surface which is produced by the method according to the invention.

FIG. 5 shows the area of overlap 50 of the jets 21 from the nozzle member 25, i.e., of the sealing surface sections 9*a*. As shown in FIG. 5, the nozzle members 25 may travel simultaneously in adjacent pipes 44. If one wishes to keep the technical expenditure low, then the nozzle member 25 is moved in succession through the pipes 44.

Figure 6:
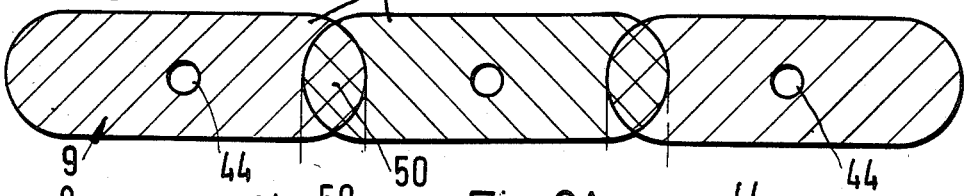
FIG. 6 is a view showing a section taken along line VI—VI of FIG. 6A.
Figure 6A:
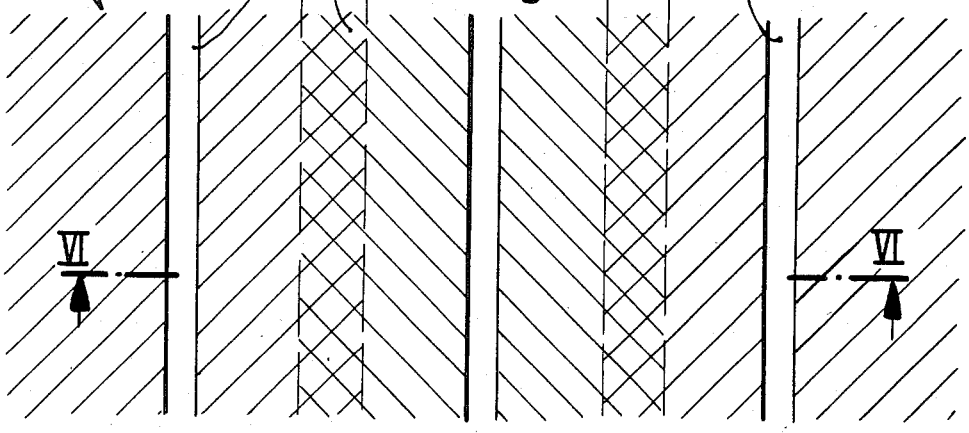
FIG. 6A is a view showing a horizontal section through a sealing surface, in which parallel pipes are embedded.

The hydraulic jet 21 is introduced at high pressure, and with a high outlet speed and concentration of the jet, through the openings 47, 47*a* into the earth 28. When the jet 21 makes contact, the soil constituents are loosened and, due to considerable turbulence, are mixed intensively with the binders, water, and/or chemicals located in the jet 21. The turbulence is produced by rebounding of the jet 21 on the solid layer of earth and on the already loosened soil constituents. The mixed constituents form a suspension 22 of soil material, binders, water, and/or chemicals. Depending on the nature of the soil, the binder, and the like, the suspension may be semi-dry to liquid. As the nozzle member 25 travels further, the suspension 22 may solidify to form the durable sealing compound 9. It may be hard, but also flexible like a membrane. The choice of binder, water, and/or chemicals is made according to the demand for sealing the dump, and the danger rating of the deposited harmful substances. For example, for such a mixture of additives, it is possible to use cement as the binder, water, and bentonite with or without chemical additives. Other variations of the mixtures may consist of chemicals with or without hardening additives, as known per se Although the jet 21 enters the ground 28 in a concentrated manner, as a result of the high turbulence the earth is loosened and mixed in a larger area (FIG. 6). The pipes 44 are therefore embedded in the sealing compound 9.

FIG. 7 shows an exemplary sealing of a slotted pipe 44', which can be moved as a mobile mechanical connection 43 by means of the two carriages 37 (FIG. 2) through the ground 28. The pipe 44' has two slots 48 which extend approximately over the entire length of the pipe and are disposed diametrically opposite each other (FIG. 8.1 and 8.2). The slots can be covered by two elastically yielding sealing lips 62, 62', which are attached to the pipe 44' above and below the slots 48, and in the sealing position (FIG. 8.1) close one against the other. The nozzles 26, 29 of the nozzle member 25 are respectively provided with an opening wedge 63, which has the outer contour shown in FIG. 7, and expands the sealing lips 62, 62' elastically solely in the direct nozzle region, when it travels through the pipe 44' (FIG. 7 and FIG. 8.2), in order that the respective material can be sprayed into the earth. In the region beyond the opening part 63, the adjoining sealing lips 62, 62' close off the slots 48 (FIG. 7), so that the pipe 44' is sealed in a trouble-free manner in this region.

Figure 11:
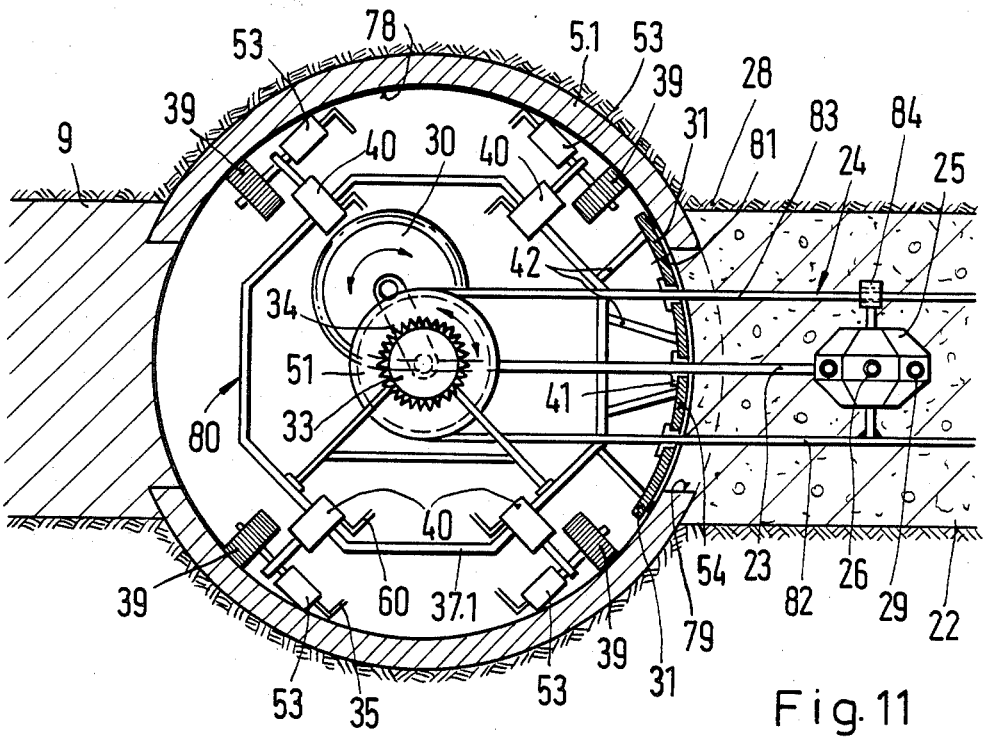
FIG. 11 is a view that shows the apparatus according to FIG. 10 in section and in elevation.

FIGS. 9 to 11 show a preferred embodiment of an apparatus for producing the sealing compound 9. The nozzle member 25 is attached to an endless cable 24, which may also be replaced by an endless chain. The nozzle member 25 is moved back and forth by the cable 24 between the two working pipes 5.1 and 5.2. The nozzle member 25 itself is attached to the cable 24 in such a way that it cannot move. The nozzle member 25 is attached to the lower side 82 of the cable 24. For the upper side 83, the nozzle member 25 has a guide sleeve 84, through which the upper side is guided loosely. FIG. 11 shows the main nozzle 26, which is disposed centrally between two auxiliary nozzles 29. Several nozzle members 25 may be provided on the cable 24. The main nozzles 26 and the auxiliary nozzles 29 of the nozzle member 25 are supplied by way of a supply line 23. By cancelling out the reaction forces, the opposed main nozzles 26 keep the nozzle member 25 in a suspended state, so that by way of the cable forces, only the specific weight of the nozzle member 25 and the frictional forces must be applied on traveling through the suspension 22. The auxiliary nozzles 29 are nozzles for producing homogeneous mixing of the suspension 22, and are inserted as required. In the direction of travel 77 (FIG. 9), in the region of the jet 21, which oscillates as a result of the suspension of the nozzle member, the earth 28 is loosened and mixed with the additives sprayed in. In the region of the nozzle member 25, the suspension 22 is mixed and hardens outside the region of influence of the nozzle in individual layers 27 to form the sealing compound 9.

The cable 24 is tensioned by a guide roller 32 and a drive roller 51 between the working pipes 5.1 and 5.2 (FIG. 10). The guide roller 32 is provided on the carriage 37.2, and the drive roller 51 is provided on the carriage 37.1; both carriages are able to travel in the working pipes 5.2 and 5.1. The cable 24 may be tightened by a hydraulic tensioning device 57 located on the carriage 37.2 (FIG. 10). The traveling carriages 37.1, 37.2 are supported by wheels 39 on the inner wall 78 of the working pipes 5.1, 5.2 (FIG. 11). Each wheel 39 is driven by its own drive motor 53. As shown in FIG. 10, the wheels 39 are provided at each end of the carriages 37.1 and 37.2.

Since the cable 24 travels continuously through the earth by the carriages, the working pipes 5.1 and 5.2 must be provided with slots for the passage of the cable, of the nozzle member 25, and of the feed line 23. For this purpose, a cutting or milling tool 36 is provided on each carriage 37.1 and 37.2; the tool, when viewed in the direction of advance 77, is located in front of the cable 24. Furthermore, each carriage 37.1, 37.2 supports a sealing plate 31, which seals the slot 79 in the working pipe 5.1 and 5.2 produced by the milling tools 36, and prevents the penetration of suspension 22 into the working pipes. The cable 24 and the feed line 23 for the nozzle member 25 project through sliding seals 41 in the sealing plate 31 into the earth 28. At its end adjacent to the milling tools 36, the sealing plate 31 is constructed to be thicker, and projects by the thickness of the working pipes 5.1, 5.2 beyond the inner wall 78, so that this end of the sealing plate bears against the earth 28 (FIG. 10). In the region of the suspension 22, the sealing plate 31 is thinner and lies completely within the working pipes 5.1 and 5.2.

As shown in FIG. 11, the sealing plate 31 is curved in the form of part of a circle, and its longitudinal edges bear against the inner wall 78 of the working pipes 5.1 and 5.2. The sealing plate 31 is connected by struts 42 to the respective carriage.

The drive roller 51 on the carriage 37.1 is driven by a suitable drive motor 33, which is likewise mounted on the carriage. The drive roller 51 is connected by way of a transmission 34 to a line drum 30 for the feed line 23. The control is carried out in such a way that when the nozzle member 25 moves, the feed line 23 always remains taut. The line drum 30 is connected by a feed line 35 to a feed station (not shown) on the surface of the ground. Further feed lines 35 supply current and hydraulic fluid for the operation of the drive motors 33, 53 and the tensioning device 57. Associated with each wheel 39 is a hydraulic press 40, by means of which the wheel can be pressed firmly against the inner wall 78 of the working pipes 5.1, 5.2. Since the wheels 39 are distributed over the periphery of the working pipes (FIG. 11), the carriages 37.1, 37.2 are supported uniformly and are driven reliably. The wheels 39 may be provided with a friction lining or a profile in order to ensure a reliable frictional contact on the inner wall 78. The presses 40 are connected by hydraulic lines 60 to a source (not shown) of hydraulic fluid. The hydraulic circuits are associated with the using devices by way of a suitable valve and control unit 52. The carriages 37.1 and 37.2 travel in the working pipes 5.1, 5.2 at a speed which ensures that the cable 24 is always moving within the suspension 22 and never comes into contact with the solid, unloosened earth 28.

The wheels 39 can be adjusted hydraulically independently of each other, so that it is ensured that they always bear against the inner wall 78 of the working pipes 5.1, 5.2. The carriages 37.1, 37.2 have a stable frame 80 for receiving all of the units for the operation of the nozzle members 25 and for the drive of the carriages. The sealing plate 31 has a removable cover 54, with which an opening 81 for repairs and assembly of the nozzle member 25 can be closed off. After removal of the cover 54, access to the nozzle member which has traveled up to the working pipe is ensured. The cover 54 is provided with the sliding seals 41 for the supply line 23 and the cable 24. In order to prevent uncontrolled leakage of the suspension 22 when the cover 54 is opened, the working pipe 5.1, 5.2 is partitioned before and after the carriages 37.1, 37.2, and the interior of the working pipe is pressurized. After reaching the existing pressure of the suspension 22, the cover 54 can be removed. In this case, only so much suspension is conveyed into the working pipe 5.1, 5.2 that the nozzle member 25 which has traveled up to the working pipe is freely accessible.

Figure 12:
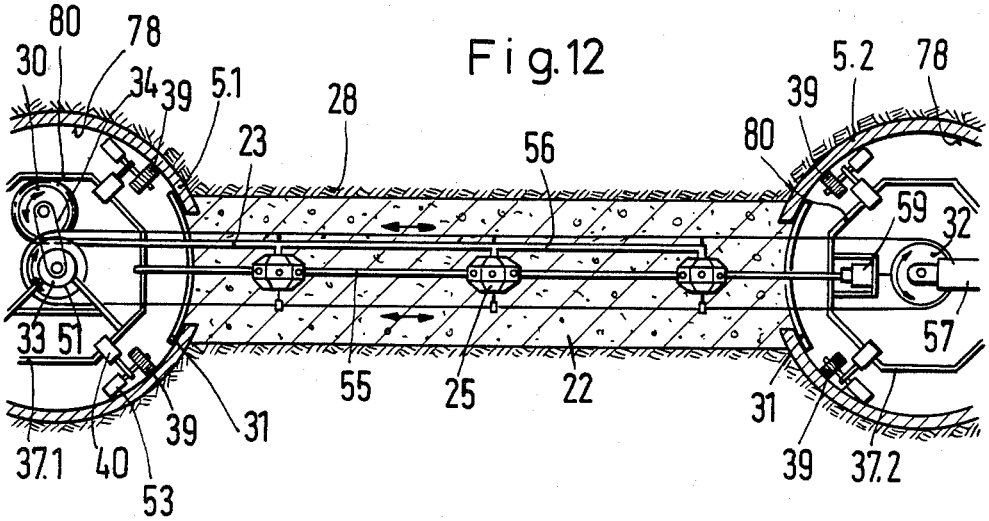
FIG. 12 is a view that shows a further embodiment of an apparatus according to the invention, in side view.

In the embodiment according to FIG. 12, several nozzle members 25 are seated on a rod 55, which extends between adjacent working pipes 5.1 and 5.2 and has, for example, a beveled or round, hollow or closed profile. The two ends of the rod 55 are attached to the frame 80 of the carriages 37.1, 37.2, which are constructed in the same way as in the previous embodiment. The nozzle members 25 are guided on the rod 55 and, as described in connection with the previous embodiment, are connected to the cable 24, which may also be replaced by a chain. The rod 55 passes through the centers of the nozzle members 25. The nozzle members 25 are connected to each other by a fixed supply line 56, which is connected by the flexible supply line 23 to the line drum 30, and is attached to the cable 24. In this embodiment, only nozzle member 25 can be provided.

Instead of being moved by a cable, a chain, and the like, the nozzle members may also be moved by suitable drive motors with a rack and pinion within a construction of the guide rod 55 having the shape of a hollow profile.

The rod 55 is rigidly attached to the carriages 37.1 and 37.2 at its end which is on the left-hand side in FIG. 12, and it is able to move in the longitudinal direction by its end which is on the right-hand side in FIG. 12. The right-hand end of the rod forms part of a press ram 59, by which the rod 55 is suspended from the frame 80 in such a way that it is able to move longitudinally. The suspension of the rod 55 allows the partial acceptance of the support force of the carriages against the inside of the pipe facing the other working pipe 5.1, and thus relieves the working pipe in its static and dynamic load. The press ram 59 serves as a tensioning device for the rod 55, and can be operated hydraulically. It is likewise connected to the valve and control unit 52 (FIG. 11).

In the embodiments according to FIGS. 13 to 16, the earth is loosened and mixed by mechanical devices and not, as illustrated previously, by hydraulic jet pressure and regions of turbulence. The mechanical loosening and mixing devices are advantageously moved in one direction, or back and forth, along a rod, a continuous cable 24, or a chain.

Figure 13:
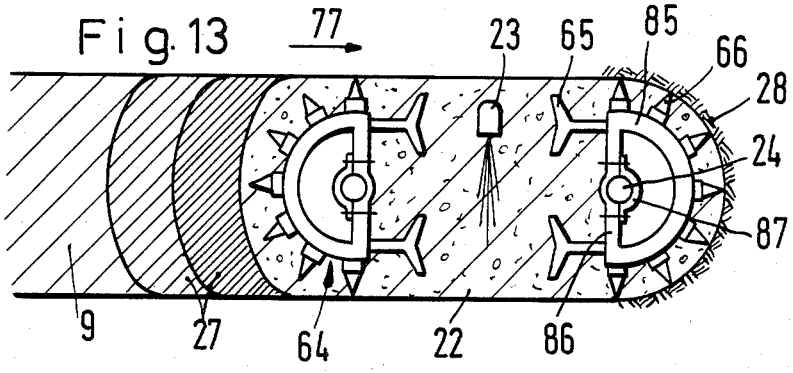
FIG. 13 is a view shows a further embodiment of an apparatus according to the invention, in section and in a diagrammatic illustration.
Figure 14:
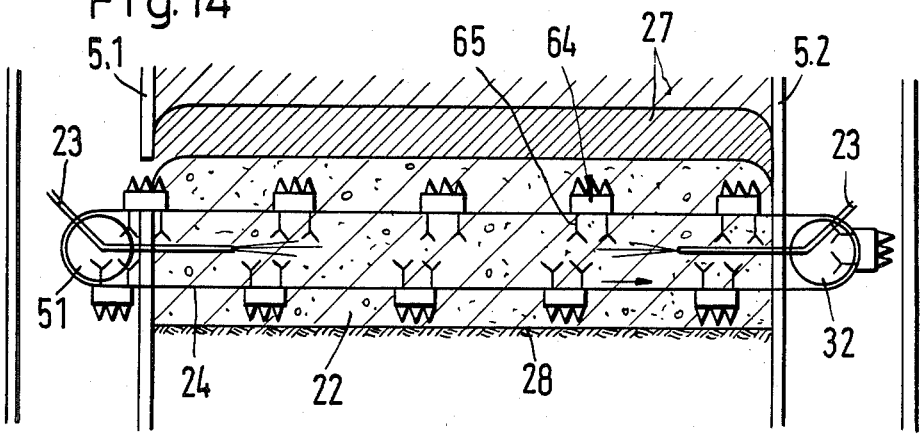
FIG. 14 is a plan view of the apparatus according to FIG. 13.

Attached at intervals to the cable 24, according to FIGS. 13 and 14, are several mechanical scraper deives 64, which loosen the earth 28 in the direction of advance. The scraper devices 64 have a support frame 85 of semi-circular cross section, to which scrapers 66 are attached, with which the earth 28 is loosened. The support frame 85 is attached by a plate-like crosspiece 86 and a clamp strap 87 to the cable 24. Provided on the outside of the crosspiece 86 are mixers 65 in the form of paddles, shovels, or similar shapes suitable for mixing. The cable 24 is guided over the guide roller 32 and the drive roller 51, which in conformity with the preceding embodiments are mounted on the carriages which are able to move in the working pipes 5.1 and 5.2. However, in contrast to these embodiments, the cable 24 lies in a horizontal plane, whereas in the previous embodiments it is located in a vertical plane. The scraper devices 64 are mounted on both sides of the cable 24 in such a way that the scrapers 66 lie on the remote sides, and the mixers 65 lie on facing sides, of the scraper devices on both sides of the cable (FIG. 14) The supply lines 23 are guided out of the working pipes 5.1, 5.2, and in the guide region of the cable 24 extend between its two sides. The additives are supplied by the supply lines 23 to the soil constituents loosened by the scrapers 66, and are mixed by the rotating scrapers with the loosened soil constituents. The additional mixers 65 assist in and/or improve the mixing of the suspension 22 formed in this way to produce a homogeneous mixture, which solidifies in layers (layers 27), to produce the sealing compound 9, on the side opposite to the advance direction 77, and beyond the region influenced by the rotating scraper devices 64.

The carriages in the working pipes 5.1 and 5.2, and the units located thereon, correspond to the preceding embodiments.

Figure 15:
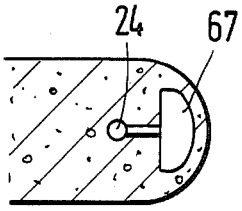
FIG. 15 is a view showing a diagrammatic illustration of a further embodiment of an apparatus according to the invention, with which soil constituents are loosened mechanically from the ground and are mixed.

In the embodiment according to FIG. 15, the mechanical loosening devices are replaced by scratching, scraping, or cutting, shovel-like tools 67, which loosen the soil and mix it with the additives supplied. In this case also, additional mixers may be provided on the continuous chain or on the cable 24.

Figure 16:
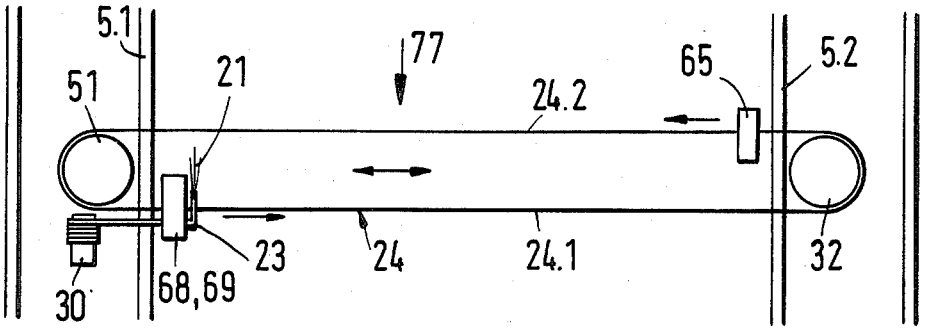
FIG. 16 is a plan view of a further embodiment of an apparatus according to the invention for the mechanical loosening and mixing of soil constituents.

FIG. 16 shows the cable 24 in the same horizontal arrangement as in the embodiment according to FIGS. 13 and 14. The cable 24 is guided over the guide roller 32 and the drive roller 51, which are arranged on the carriages (not shown) in the working pipes 5.1, 5.2.

Attached to the cable 24, which may also be replaced by a chain, are earth saws 68 or milling tools 69, the axes of rotation of which extend in the longitudinal direction of the cable 24. In this case, on the front cable side 24.1 in the advance direction 77, at least one saw or one milling tool 69, and on the rear cable side 24.2 in the advance direction, at least one mixing device 65 attached thereto in the form of shovel or bucket-like mixing tools, is moved back and forth between the working pipes 5.1 and 5.2 The carriages, and the devices arranged thereon, are in other respects constructed in the same manner as in the embodiment according to FIGS. 9 to 11. The supply line 23 is guided 25 far as the earth saw 28 or milling tool 69, and is directed with its opening towards the opposite cable side 24.2. The jet 21 emerging from the supply line 23 thus passes into the path of movement of the mixing device 65, so that the additives are mixed intensively with the mechanically loosened soil constituents. The supply line 23 is flexible, and can be wound on the line drum 30.

With the methods and apparatus described, it is possible to produce a sheet-like seal from a mixture of loosened soil and additives subsequently and predominantly horizontally below an existing dump body 1, and between and along the working pipes. As regards size, the inside diameters of the working pipes are approximately two meters, thus making it possible to walk through them, and the inside diameter of the pipes 44 is between approximately 0.2 and 0.5 meters. The thickness of the sealing compound 9 is advantageously between 0.6 and 1.5 meters.

The contaminated dump body 1 can also be completely encapsulated by the method described hereafter with reference to FIGS. 17 to 22.

Figure 17:
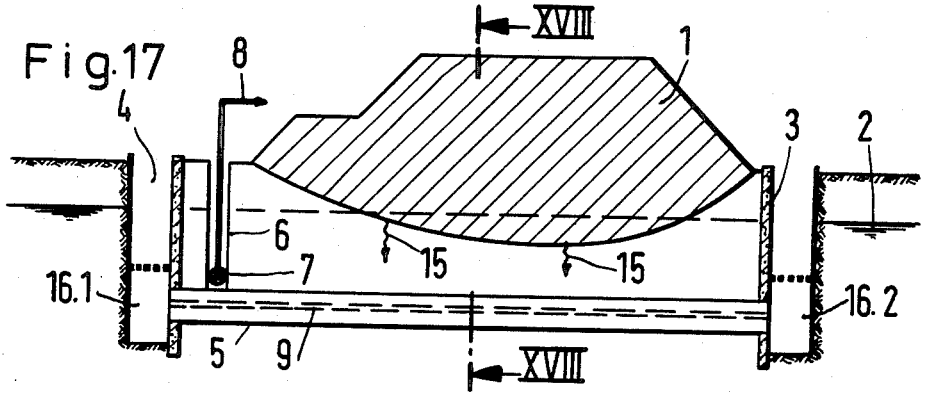
FIG. 17 is a view showing a section through underground vertical and horizontal sealing, of a dump body, produced according to the method of the invention.

FIG. 17 shows a dump body 1 which has been sealed underground subsequently, and which in this case, for example, opens into the ground water. First of all, a sealing wall 3 is erected in known manner all around the dump body 1 for vertical sealing; this wall 3 is sunk to below the horizontal sealing surface 9 which is to be introduced. The sealing wall 3 at the same time serves as a building wall on the dump side for the erection of vertical shafts 4, which serve for the installation of the working pipes 5 at the intervals provided therefor. If required, the shafts 4 may be connected to each other, at the height of the working pipes 5 which are to be installed, by a horizontal gallery 16.1, 16.2. From the floor of the shaft 4, or from the gallery 16.1, the working pipes 5 are then installed by the driving method in pipe sections as far as the opposite shaft 4 or gallery 16.2. The sealing compound 9 is then produced in the manner described between the working pipes 5. The dump body 1 is thus encased underground completely with regard to the ground water 2. The ground water remaining within the dump body 1 after sealing can, by means of wells 6 and the installation of pumps 7 and discharge lines 8, be fed to a systematic discharge system. Accumulations of contaminated seepage waters 15 inside the sealed region may also be discharged at the same time by means of the wells 6.

The sealing wall 3 extends parallel to the working pipes 5. In the longitudinal direction of the working pipes, one working pipe 5 extends outside the sealing wall 3, and the adjacent working pipe 5.1 extends inside the sealing wall. In this case, the sealing wall 3 is penetrated at the height provided exactly like the existing ground 28, in which case a slot-like opening 89 is produced. The loosened material of the sealing wall 3 is then mixed with the additives to produce the sealing compound 9, which extends into the slot-like opening 89.

Figure 19:
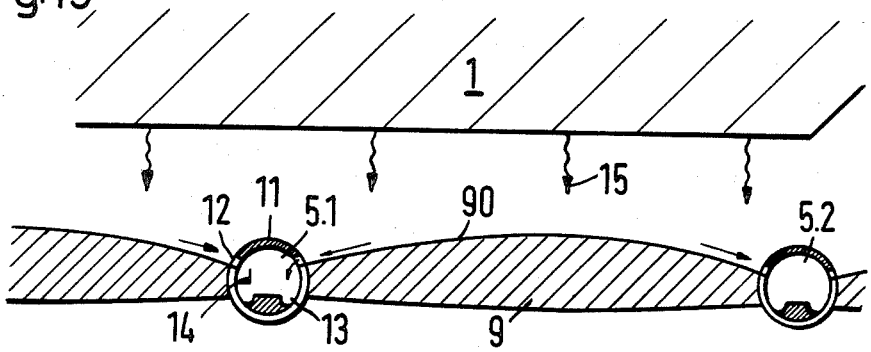
FIG. 19 is a view showing a section and diagrammatic illustration of a further embodiment of horizontal sealing of a dump body.

By way of example, FIG. 19 shows a central elevation of the sealing surfaces 9 between the working pipes 5, with said elevations having a convex upper side 90 by means of which seepage waters 15 are guided to the working pipes, into which they pass through openings 12 in the wall 11 of the working pipe, from where they are discharged in channels 13 or in collecting pipes (not shown). The quantity of seepage waters 15 occurring can be determined in measuring vessels 14 in the working pipes, and if necessary may be transmitted to a quality control unit.

FIG. 20 is a plan view of a dump sealed by the aforedescribed method. The shafts 4 respectively represent the connection of the gallery 16 to the earth's surface. Running along these galleries 16 is the sealing wall 3, which also vertically seals the respective side faces between the galleries. Several wells 6 are distributed over the sealing surfaces 9. In plan view, the working pipes 5 project beyond the dump body 1, so that in plan view, the galleries 16 and the sealing wall 3 surround the dump body.

Figure 21:
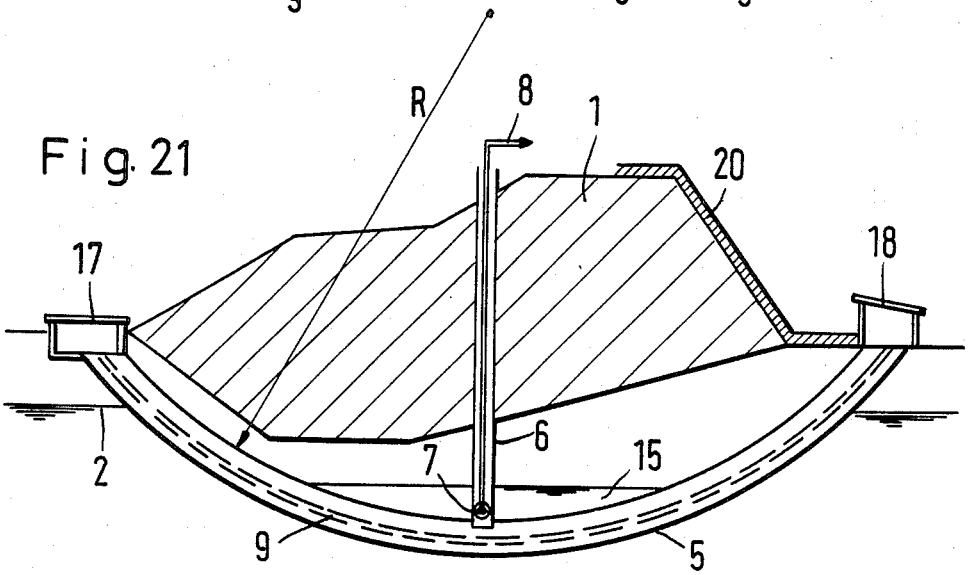
FIG. 21 is a view showing a diagrammatic illustration and section of a sealing surface which extends in a curve and is located below a dump body.

FIG. 21 shows a variation of a subsequently installed, predominantly horizontal seal of a dump body 1, in which the working pipes 5 are installed from the earth's surface, and have a central axis which is curved when viewed in vertical section As a result no shafts, sealing walls, and the like are necessary. The sealing surface 9, which is produced according to the previously described methods, has a trough-like construction as a result of the curved working pipes 5. For example, an axial curvature of constant radius R is illustrated. The ends of the working pipes 5 may lie either at the height of the earth's surface, (left-hand half in FIG. 21), or may be provided with a cover 18 above ground (right-hand half in FIG. 21). In addition, the dump body 1 may be provided with a cover 20, which allows extensive reduction of seepage waters 15, so that in this variation, only a small quantity of seepage water 15 has to be discharged by means of the wells 6, the pump 7, and the line 8. Seepage water 15 of this type will appropriately be subjected to continuous checking, and will be supplied for purification.

Figure 22:
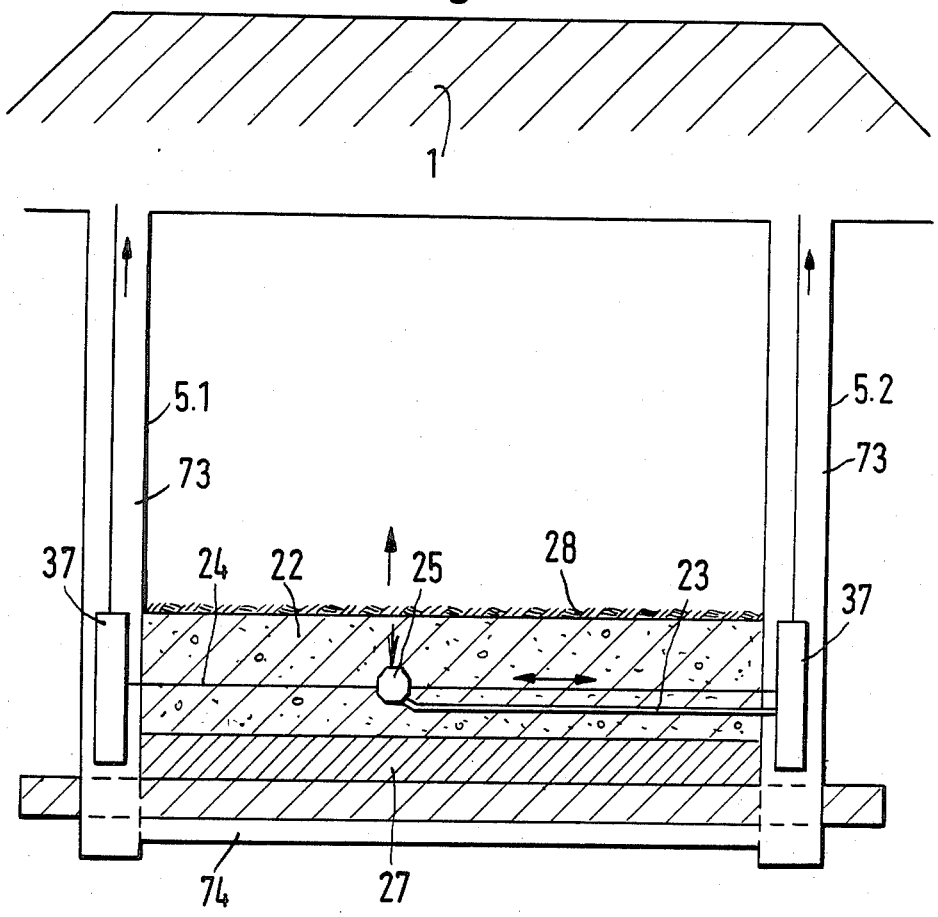
FIG. 22 is a view showing a section through a vertical seal, of a dump body, produced by the method according to the invention.

The inventive method is not only an advantageous type of subsequent underground sealing for the installation of horizontal or slightly inclined sealing surfaces, for even vertical sealing surfaces can be produced (FIG. 22). In this case, the working pipes are introduced vertically and form vertical shafts 73, which may have any desired cross section. In the working pipes 5.1 and 5.2, the carriages 37, together with the aforementioned devices for producing the sealing surface 9, are drawn upwardly. In order that the carriages can be connected to each other, the working pipes 5.1 and 5.2 are connected to each other by an underground, installed horizontal gallery 74. In the latter, the carriages 37 are connected to each other, so that they can then be pulled up. The installation of the vertical sealing surface 9 between the vertical shafts 73 thus takes place in the same manner as with the predominantly horizontal production, i.e., in sections or continuously by reciprocating mechanical or hydraulic loosening and mixing devices for producing a sealing layer of soil constituents and supplied additives.

The choice of additives has no significance for carrying out the method. It is determined solely by the composition of the soil material and the requirements as regards values of permeability of the seal which is to be produced. For most problems and objectives, additives of this type or suitable mixtures are available or known.

The sealing surfaces 9 can be produced in different thicknesses. The different thicknesses are adjusted by means of the pressure of the jet, the density of the jet, and the guidance of the jet. The nozzle members 25 may also be adjustable, so that the direction of the jet can be adapted to the respective conditions.

If the hydraulically or mechanically loosened soil material is mixed with binder to form the suspension 22, then even before solidification, the suspension has a support function and prevents the collapse of adjacent layers of soil.

Figure 18:
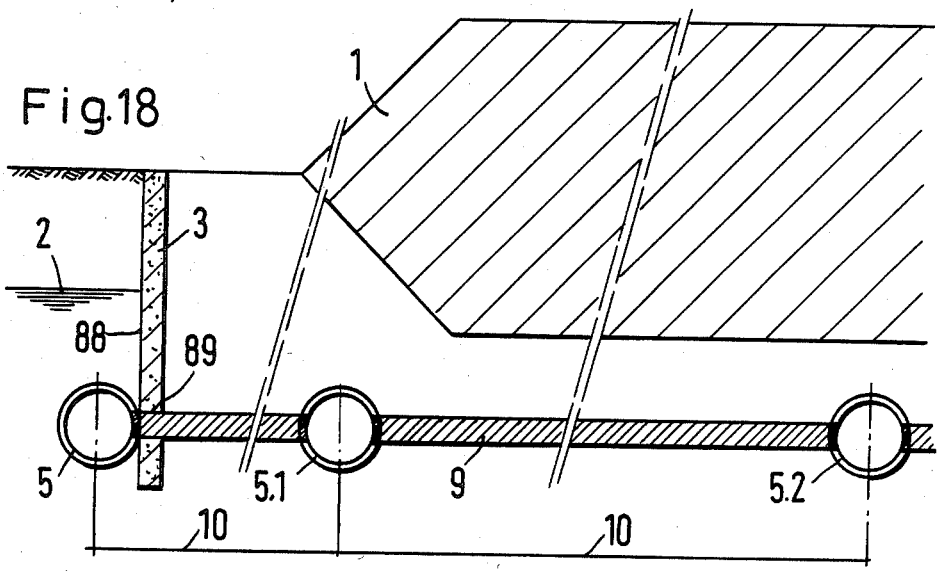
FIG. 18 is a view showing a section taken along line XVIII—XVIII of FIG. 17.

As described with reference to FIGS. 17 and 18, the shafts 4 are connected to each other by the galleries 16.1 and 16.2. They serve for the assembly of the carriages 37, which are then moved through the working pipes 5. In place of the galleries, a connecting pipe introduced by the driving method may be located between the shafts 4 or between the working pipes 5; in this connecting pipe, the mechanical connection 43 between the traveling carriages 37 can be located. This mechanical connection 43 may be formed by the cable 24, the chain, the rod 55, and the like, on which the nozzle member 25 or the mechanical devices are attached and guided.

The present invention is, of course, in no way restricted to the specific disclosure of the specification and drawings, but also encompasses any modifications within the scope of the appended claims.

What we claim is:

1. A method for subsequently producing an underground seal for an area, including the step of inserting sealing material to form a horizontal water impermeable barrier into the ground externally of and below said area which is to be sealed; the improvement therewith which includes the steps of:

installing working pipes in a region below and externally of said area which is to be sealed;

introducing sealing material into earth between adjacent ones of said working pipes, said sealing material hardening for forming said water impermeable barrier;

introducing said sealing material in at least one jet, which is movable in a horizontal plane; providing connecting pipes for connecting said work pipes, and introducing the sealing material to form a complete horizontal water-impermeable barrier by breaking through the walls of said connecting pipes with said at least one jet movable in the horizontal plane.

2. A method according to claim 1, which includes the the step of selecting, for said sealing material, binders water respectively chemicals.

3. A method according to claim 1, which includes the step of mixing said sealing material with at least a portion of said earth to form a suspension, which hardens to form a complete horizontal water-impermeable barrier.

4. A method according to claim 1, which includes the steps of driving said working pipes into the ground from a first gallery, and driving them from there underneath said area which is to be sealed into a terminal gallery.

5. A method according to claim 4, which includes the step of providing vertical cut-off walls around said area which is to be sealed, said cut-off walls being traversed by said working pipes as they are driven in.

6. A method according to claim 5 which, in the longitudinal direction of said working pipes, includes the steps of installing one working pipe outside said cut-off wall, and installing the adjacent working pipe within said cut-off wall.

7. A method according to claim 1, which includes the step of increasing the thickness of sealing compound progressively from working pipes.

8. A method according to claim 1, which, from the surface of the ground and beyond the area to be sealed includes the step of driving said working pipes, into the ground below said area which is to be sealed, in an arcuate path of a given radius.

9. A method according to claim 1, which includes the step of providing wells, pumps, and discharge lines for withdrawing seepage water and ground water located within said area which is to be sealed after forming of said complete water-impermeable barrier, and for conveying said water to a purification unit.

10. An apparatus for subsequently producing, for an area, an underground seal in the form of a water-impermeable barrier beyond and below said area which is to be sealed; the improvement therewith comprising:

working pipes in a region below and externally of said area which is to be sealed;

at least one loosening device for loosening earth between adjacent ones of said working pipes; and means including at least one feed device for introducing sealing material into said earth between adjacent ones of said working pipes to form said water-impermeable barrier; said loosening device and feed device being movable respectively in the region between adjacent ones of said working pipes and contained in connecting pipes connecting said working pipes.

11. An apparatus according to claim 10, in which said loosening device is formed by at least one injection member.

12. An apparatus according to claim 11, which includes said connecting pipes for connecting adjacent ones of said working pipes; and in which said injection member is moveable within one of said connecting pipes.

13. An apparatus according to claim 10, which includes a holding device, which extends through one of said connecting pipes; said loosening device is mounted on said holding device.

14. An apparatus according to claim 12, which includes said connecting pipes for connecting adjacent ones of said working pipes and to house the loosening and feed device for discharging sealing material; and in which said connecting pipes are provided with at least one opening for at least one of said loosening device and said feed device.

15. An apparatus according to claim 12, which includes said connecting pipes for connecting adjacent ones of said working pipes; and in which said loosening device and said feed device are a single unit provided with at least one jet for discharging sealing material at an impact force of passage which is greater than the strength of the walls of said connecting pipes, so that the sealing material breaks through the walls and forms the impermeable barrier.

16. An apparatus according to claim 14, in which said at least one opening is slot-shaped; and which includes at least one resilent sealing member for sealing said slot-shaped opening.

17. An apparatus according to claim 16, which includes two of said resilient sealing member for said slot-shaped opening; and in which said feed device is provided with a wedge-shaped element for locally elastically bending said sealing members apart.

18. An appartus according to claim 10, in which said loosening device and said feed device are a single unit which introduce the said sealing material into the ground at high pressure to loosen the ground and at the same time mix it with said sealing material.

19. An apparatus according to claim 10, in which said working pipes are dimensioned such that it is possible to walk through them.

20. An apparatus for subsequently producing, for an area, an underground seal in the form of a water-impermeable barrier beyond and below said area which is to be sealed; the improvement therewith comprising:

working pipes in a region outside said area which is to be sealed and from which others can be installed whilst leaving the region to be sealed intact;

at least one losening device for loosening earth between adjacent ones of said working pipes;

at least one feed device for introducing sealing material into said earth between adjacent ones of said working pipes to form said water-impermeable barrier; said loosening and feed devices being movable in the region between adjacent ones of said working pipes via a pull device and a movable carriage or vehicle within the working pipes that is connected to the pull device.

21. An apparatus according to claim 20, which includes said pull device is disposed between adjacent ones of said working pipes for moving said loosening device respectively said feed device therebetween.

22. An apparatus according to claim 21, which includes a rigid guide which extends between adjacent ones of said working pipes; said loosening device is guided on said guide.

23. An apparatus according to claim 21, which includes a first support carriage, which has a drive roller, in one of said working pipes, and a second support carriage, which has a guide roller, in the adjacent working pipe; said pulling means is guided over said drive roller and said guide roller.

24. An apparatus according to claim 23, in which said pulling means has a first run to which said loosening device is attached, and a second run along which said loosening device is slidingly guided.

25. An apparatus according to claim 23, which includes a drive motor for said drive roller, a supply line for said feed device, a drum onto which said feed line is wound, and a transmission for connecting said drum to said drive motor.

26. An apparatus according to claim 25, in which support carriages are provided with wheels to support them on the inner walls of said working pipes in a mobable manner; said drum, said transmission, said drive motor, and a hydraulic control, regulation, and distribution unit are accommodated on one of said carriages, which is also provided with feed lines.

27. An apparatus according to claim 23, in which each of said support carriages, at the forward end when viewed in the direction of travel along it working pipe, is provided with at least one milling tool for milling a slot in the wall of said working pipe.

28. An apparatus according to claim 27, in which each of said support carriages is provided with at least one sealing plate for sealing said slot; said pulling means is guided through said sealing plate.

29. An apparatus according to claim 22, in which a plurality of loosening devices are movably mounted on said guide, and are interconnected by a rigid supply line which is connected to a flexible supply line for sealing material.

30. An apparatus according to claim 21, in which said loosening device is in the form of mechanically operating scraper devices which are rotatable via said pull device.

31. An apparatus according to claim 22, which includes at least one moveable earth saw mounted on said pull device and said guide for loosening earth.

32. An apparatus according to claim 22, which includes a movable milling tool mounted on one of said pulling means and said guide for milling the earth.

33. An apparatus according to claim 21, in which mixing devices are provided on said pulling means.

* * * * *